United States Patent [19]

Kemeny

[11] Patent Number: 4,888,895

[45] Date of Patent: Dec. 26, 1989

[54] PORTABLE DISPLAY SYSTEM

[76] Inventor: Matthias D. Kemeny, 1625 SW. Westwood Dr., Portland, Oreg. 97201

[21] Appl. No.: 226,292

[22] Filed: Jul. 29, 1988

[51] Int. Cl.[4] ..... G09F 15/00

[52] U.S. Cl. ..... 40/610; 52/109; 52/646

[58] Field of Search ..... 40/610, 605; 52/109, 52/646; 211/202; 160/135

[56] References Cited

U.S. PATENT DOCUMENTS

| | | | |
|---|---|---|---|
| 4,437,275 | 3/1984 | Zeigler | 52/109 |
| 4,658,560 | 4/1987 | Beaulieu | 40/610 |
| 4,747,239 | 5/1988 | Zeigler | 52/109 |
| 4,800,663 | 1/1989 | Zeigler | 40/610 |

*Primary Examiner*—Gene Mancene
*Assistant Examiner*—Cary E. Stone
*Attorney, Agent, or Firm*—Kolisch, Hartwell & Dickinson

[57] ABSTRACT

The display system of the invention includes a collapsible, rectangular frame which includes plural, rectangular box units. Each box unit includes a top side, a bottom ride, right side, left side, front face and rear face. The top side, bottom side, right side and left side may be shared with adjoining box units. The top, bottom, right and left sides are defined by a pair of arms which are joined to one another by a scissor connection. The top and bottom side arms include at least one telescoping member therein. Connector nodes are located at each corner of the box units. Each of the nodes includes a pivot for securing the arms of the frame thereto and for allowing collapsing of the frame to a compact form.

48 Claims, 5 Drawing Sheets

PORTABLE DISPLAY SYSTEM

Background of the Invention

The present invention relates to display systems, and particularly to a display system which includes a collapsible frame and a variety of devices for attaching displays to the frame.

A number of display systems are known which are both portable and collapsible. These systems typically include a number of elongate arms attached at their ends to articulation blocks or nodes which allow for the folding of the frame to a collapsed condition. Some of the known systems provide for curvature to be imparted to the frame. Such systems have provided a display capability not previously possible in that they can be constructed to form a full size display which can be collapsed to a compact shape for storage or transport. Nonetheless, such display systems are often complex in construction and therefore expensive. They also are typically limited in that each system is capable of only a single display configuration.

Additionally, a variety of structures are known for securing displays to a frame, but most of those are also complex and do not provide for the attachment of a variety of display types to a single frame.

It is an object of the present invention to overcome the drawbacks and limitations of the prior art proposals. More specifically, the invention has as its objects:

(1) to provide a portable display system having a frame which may be disposed in a planar, curved or circular pattern, as desired by the user;

(2) to develop a display system which is more simple and therefore less expensive than existing designs;

(3) the provision of a frame for a display system which includes variable length arms wherein the forearms only are connected to an individual node;

(4) to provide a display system which includes means for connecting multiple frames together; and (5) to provide connector nodes which allow the connection of multiple frames together along the edges thereof while enabling the arrangement of the frames in a desired configuration.

Summary of the Invention

The above objects are best achieved by providing a display system which includes a collapsible, rectangular frame having a plurality of rectangular box units. Each box unit includes a top side, bottom side, right side, left side, front face and rear face. Any one or all of the sides may typically be shared with adjoining box units. These sides are defined by a pair of arms which are joined to one another by a scissor connection. The top and bottom side arms include at least one telescoping member therein. Connector nodes are located at each corner of the box units. Each of the nodes includes pivot means for mounting the arms of the frame and for permitting the frame to be collapsed to a compact form.

These and other objects and advantages of the present invention will become more fully apparent as the description which follows is read with reference to the drawings.

Detailed Description of the Preferred Embodiment

Figure 1:
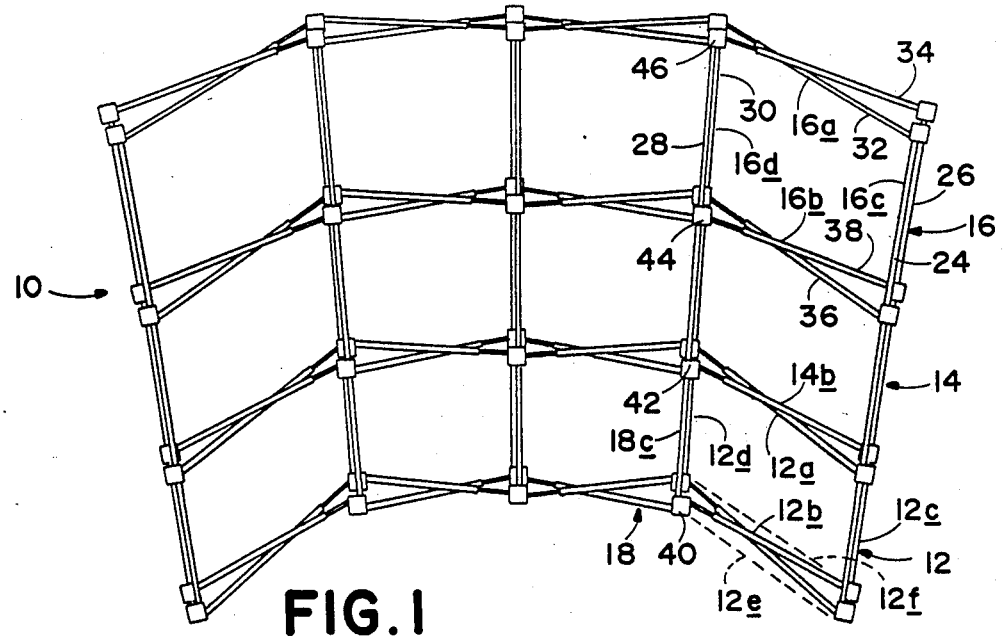
FIG. 1 is a perspective view of the frame of a preferred embodiment of the invention, in a curved condition.
Figure 2:
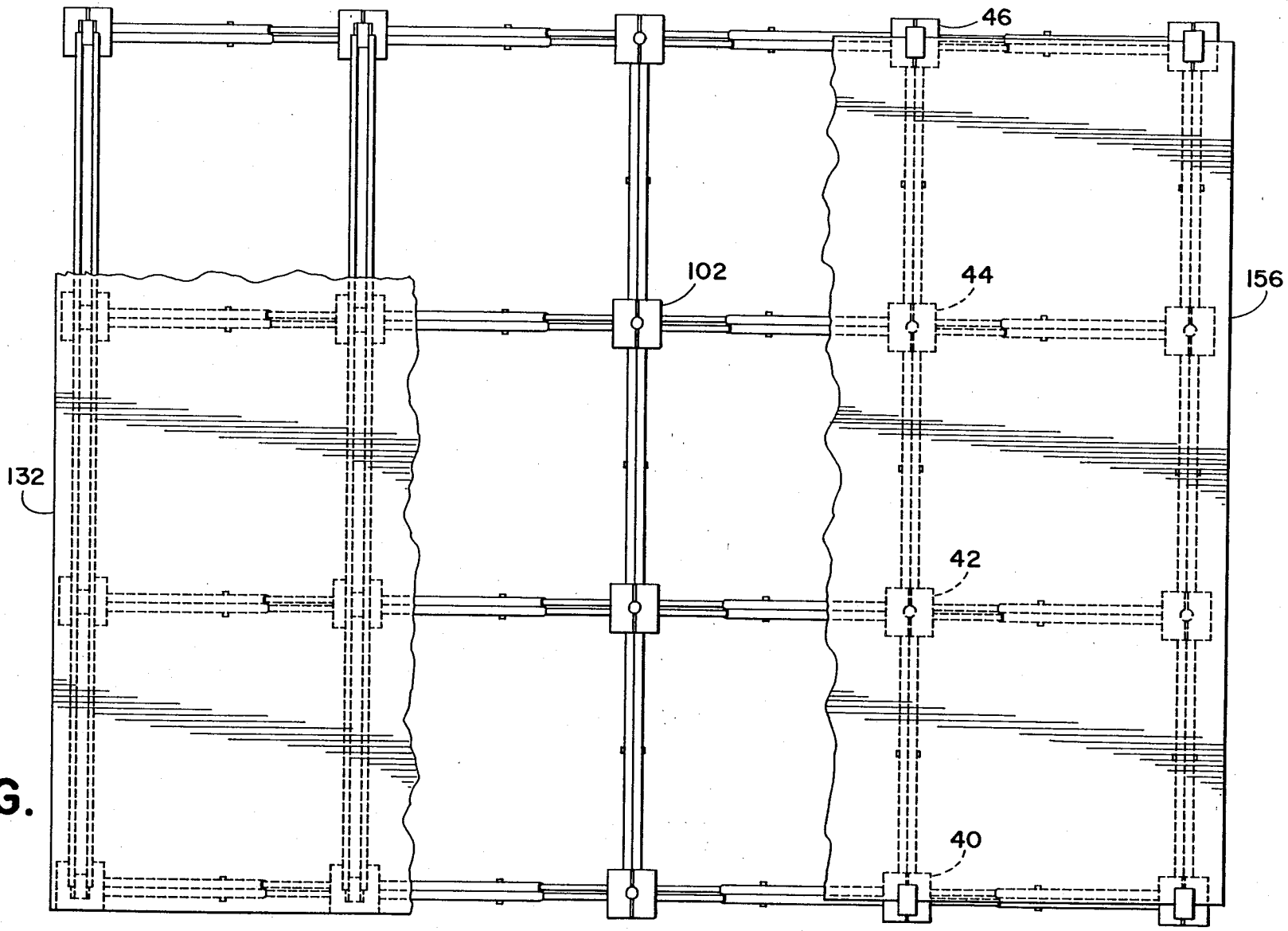
FIG. 2 is an enlarged, partially broken away, front elevation view of the embodiment of FIG. 1, in a straight condition, with portions of a display mounted to the frame.

Turning now to the drawings, and initially to FIGS. 1 and 2, a frame of the depicted embodiment is shown generally at 10. Frame 10 has a generally rectangular shape and, as will be explained in greater detail herein, is collapsible to a folded condition. The frame may be disposed in a curved, S-shaped, or straight configuration. Frame 10 is made up of a plurality of rectangular box units 12, 14 and 16. Each box unit, and now referring to box unit 12, has a top side **12*a*, a bottom side 12*b*, a right side 12*c* and a left side 12*d*. Additionally, each box unit has a front face 12*e*, which faces outward on the page, and a rear face 12*f***, which faces the page.

As may be seen in the drawing, top side **12*a* is a shared side with box unit 14, and specifically is shared by bottom side 14*b*. Likewise, left side 12*d* is shared with right side 18*c* of box unit 18**.

Each side of each of the box units is defined by a pair of arms. For example, referring to box unit 16, right side **16*c* is defined by arms 24, 26; left side 16*d* is defined by arms 28, 30; top side 16*a* is defined by arms 32, 34; and bottom side 16*b* is defined by arms 36, 38**.

Figure 3:
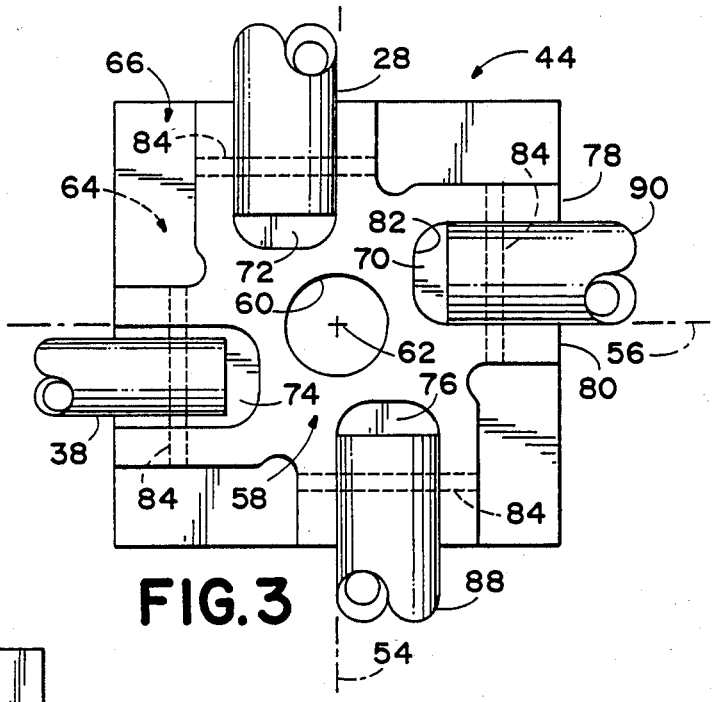
FIG. 3 is a greatly enlarged elevation view of a connector node of the depicted embodiment taken from the rear side.
Figure 4:
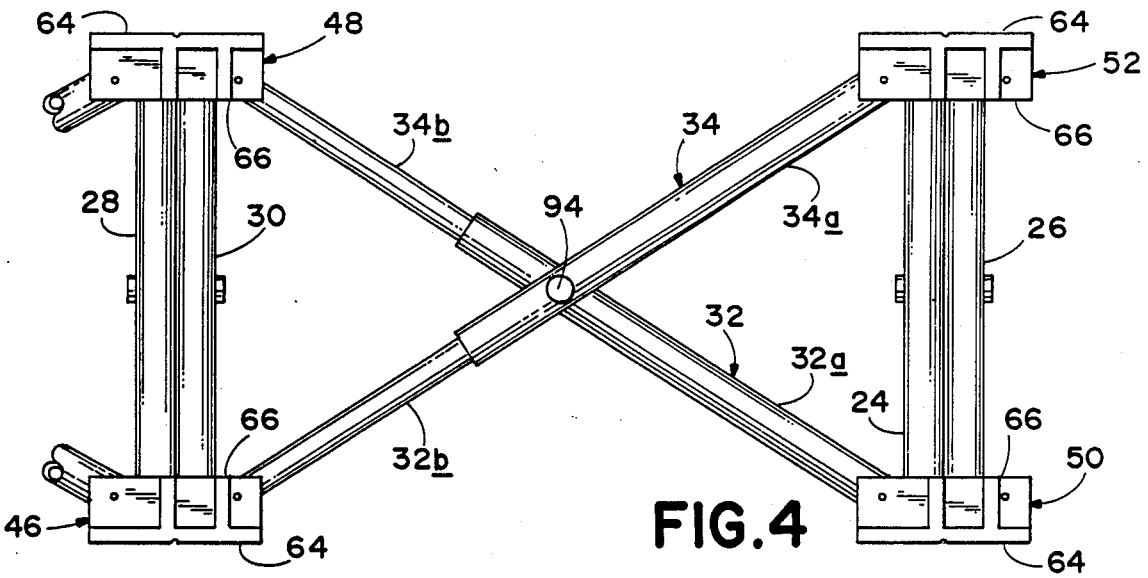
FIG. 4 is an enlarged top plan view of a portion of the frame of the depicted embodiment.

The arms defining the sides of the box units are joined to connector nodes 40, 42, 44 and 46. Additional nodes are depicted in FIG. 4 at 48, 50 and 52. Referring now to FIGS. 3 and 4, the connector nodes will be described in greater detail. It should be understood that all of the nodes in the frame are constructed identically. A node, such as node 44, shown in FIG. 3 in a greatly enlarged scale, is located at each corner of each box unit. Each node includes a vertically disposed node axis 54 and a horizontally disposed node axis 56. Axes 54 and 56 are perpendicular to one another. The depicted node includes a central region 58 which has a bore 60 extending therethrough. In the preferred embodiment, bore 60 is circular in form and is disposed about a bore axis 62 which is perpendicular to axes 54 and 56.

Each node has an exterior surface 64 which, when the node is positioned in the frame, faces outward from the frame. Each node also includes an interior surface 66 which, when the node is positioned in the frame, faces toward the interior of the frame. In the depicted, preferred embodiment, exterior surface 64 is of generally planar configuration.

Each node includes pivot means for securing the arms thereto and for allowing collapsing of the frame to a compact form. The nodes further include plural receptacles 70, 72, 74 and 76. In the preferred embodiment, the pivot means includes receptacles, such as shown at 70, 72, 74 and 76, each of which has a pair of opposed, spaced apart walls, such as walls 78, 80 which extend parallel to one of the node axes 54 or 56. Each receptacle further includes a base 82 which is adjacent central region 58. A node pin 84 extends between and perpendicular to walls 78, 80.

Arms from the various sides of the box units surrounding each node 44 are connected by the pivot means to the node. Arm 28 is connected to the node pin 84 of receptacle 72; arm 38 is connected to the node pin 84 of receptacle 74; an arm 88 is connected to the node pin 84 of receptacle 76; and an arm 90 is connected to the node pin 84 of receptacle 70.

Figure 5:
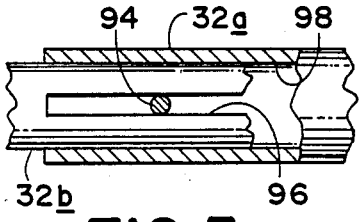
FIG. 5 is a greatly enlarged, fragmentary view of a telescoping member of the depicted embodiment, with portions broken away to show detail.

The arms, such as arms 28 and 30, are joined by a scissors pin 94, as shown in FIG. 4, forming a scissor connection between the arms. Referring now to FIG. 5, the top side arms and bottom side arms of frame 10 are shown to include a telescoping arrangement wherein a large diameter element, such as elements **32*a* and 34*a* have received therein relatively smaller diameter elements, such as 32*b* and 34*b*, respectively. The elements are secured together by a scissor pin 94 which allows arms 32 and 34 to pivot relative to one another. The small diameter elements, such as element 32*b* (FIG. 5) have, at the end thereof which is received in the larger diameter element, a pair of opposed slots 96 and 98 which are fittable around pin 94** and allow the small diameter element to be fully received in the large diameter element.

The provision of a single telescoping arm in the top and bottom sides of a box unit enables the frame to be curved in a single direction.

When telescoping elements are provided in both arms of a top and bottom side of a box unit, the four-box unit long frame may be folded such that one end of the frame contacts the other end. Additionally, the frame may be deployed in a S-curve configuration and may also be deployed with a curvature formed toward either the front or rear of the frame. If during use of the display system, the configuration needs to be changed, this can be done very simply by merely changing the degree of extension of the telescoping arm.

Figure 6:
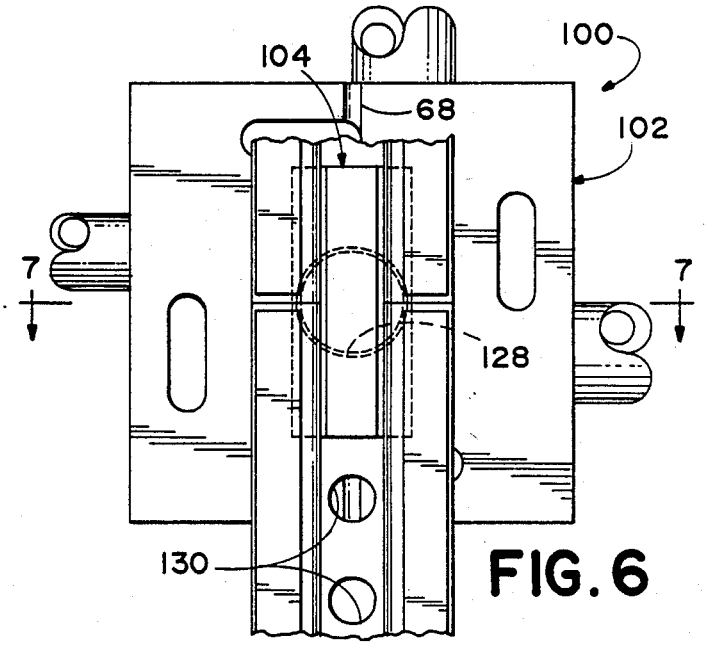
FIG. 6 is a greatly enlarged elevation view of a connector node of the depicted embodiment taken from the front side, with a bracket of the depicted embodiment attached thereto.
Figure 7:
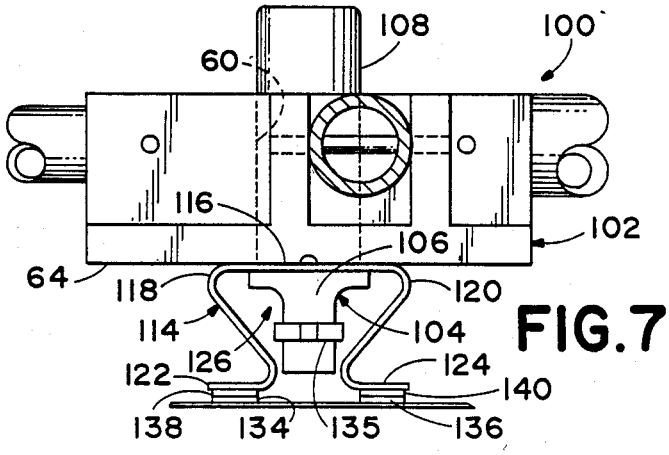
FIG. 7 is a partially sectioned view of a node and bracket, taken generally along line 7—7 of FIG. 6.

Referring now to FIGS. 6 and 7, one form of display fixing means of the invention is shown generally at 100. Fixing means 100 is secured to a node 102, which is constructed similarly to the other nodes in the frame and has arms pivotably secured thereto. The depicted embodiment includes display fixing means having a fastener 104 which includes a head 106 and a shaft 108. Shaft 108 is sized to be clearance fittable through bore 60 in the node and is held on the node by a close friction fit.

The depicted display fixing means further includes brackets, such as bracket 114, which are held to nodes 102 by fasteners 104. The brackets 114 used in the system are all identical structures and are sized to be placeable between consecutive nodes 102. Alternately, the brackets may be constructed to extend the full height of a frame. The bracket includes a rear face 116 which is positioned to contact exterior surface 64 of the node. A pair of opposed, curved resilient sides 118, 120 extend from rear face 116 outward from frame 10, when the bracket 114 is positioned on the frame. Sides 118, 120 are connected to opposed front faces, 122, 124 which, in the preferred embodiment, are substantially parallel to rear face 116. A central channel 126 extends the length of bracket 114 and is defined by rear face 116 and the curved sides 118, 120 of the bracket. A receiver 128 is formed in each end of bracket 114 and is constructed to allow passage of shaft 108 of fastener 104 therethrough.

Brackets 114 have a series of bores 130 formed in the rear face 116 thereof and are spaced at intervals suitable for the insertion of conventional peg board hooks (not shown). The hooks, once inserted, are suitable for hanging items thereon which are to be displayed with the system of the invention.

Referring now to FIGS. 2 and 7, a web 132 is fragmentarily depicted as being attached to frame 10. Web 132 has magnets 134, 136 secured to the back side thereof which cooperate with other magnets 138, 140 secured to front faces 122, 124, respectively, of bracket 114. The magnets, also referred to herein as attachment means, secure web 132 to frame 10 regardless of the curvature imparted to frame 10. Items to be displayed may be attached to the web by a variety of means.

Brackets 114 of display fixing means 100 may extend the entire height of the display 10, or each of a plurality of such brackets may extend for only a portion of the length, with the plurality of brackets being tied together by elastic straps. One of such straps is shown in section at 135 in FIG. 7.

Figure 8:
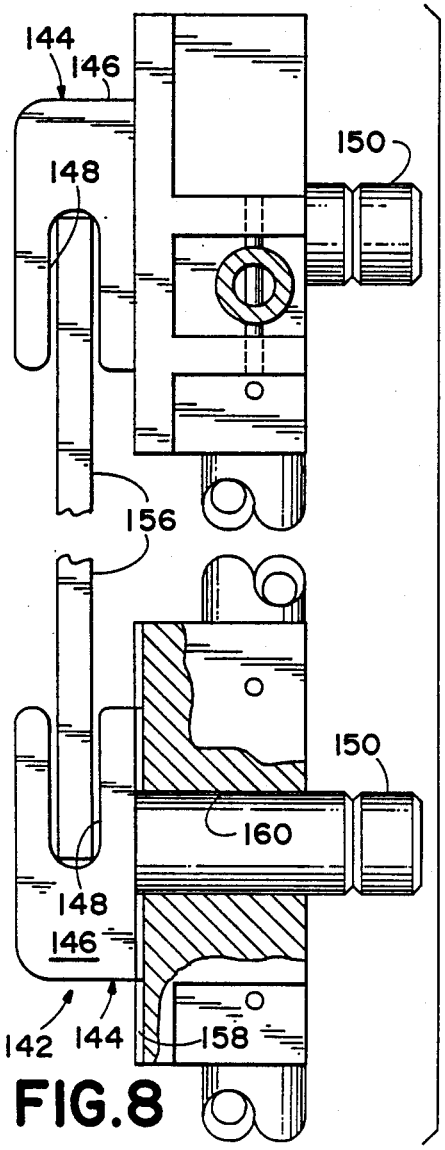
FIG. 8 is a partially sectioned, side elevation view of a portion of the frame of the depicted embodiment, with a second form of display fixing means attached thereto.

Referring now to FIGS. 2 and 8, a second form of display fixing means is depicted generally at 142. This form of display fixing means includes display holders 144, each of which includes a head 146 which defines a slot 148. Head 146 is an elongate structure and is secured to a shaft 150 which is sized to extend through bore 160 in the nodes. Means may be provided for securing holder 144 to the nodes, or the holder may be secured merely by a friction fit.

A display board 156 is captured in slots 148 and is held in place over the front exterior surface of frame 10.

Holders 144 have an index, or index means 158 which cooperates with a groove 68 to maintain the vertical orientation of head 146 relative to the nodes. Display board 156 may have a variety of devices attached thereto, such as photographs, posters, or, may be provided with means for attaching further display elements thereto. Display holders 144 will impart whatever curve is present in frame 10 to display 156.

In the preferred embodiment, frame 10 when in a fully expanded condition is approximately 8 feet high and 10 feet wide. It is, however, frequently desirable to have a display surface that is larger than the aforementioned dimensions. One way to do this of course would be to construct a frame having more than the depicted number of box units. However, in order to maintain the adaptability of the system to provide a display area of virtually any size, the individual frames may be manufactured in the manner depicted, and multiple frames may be locked together to provide larger display areas.

Figure 9:
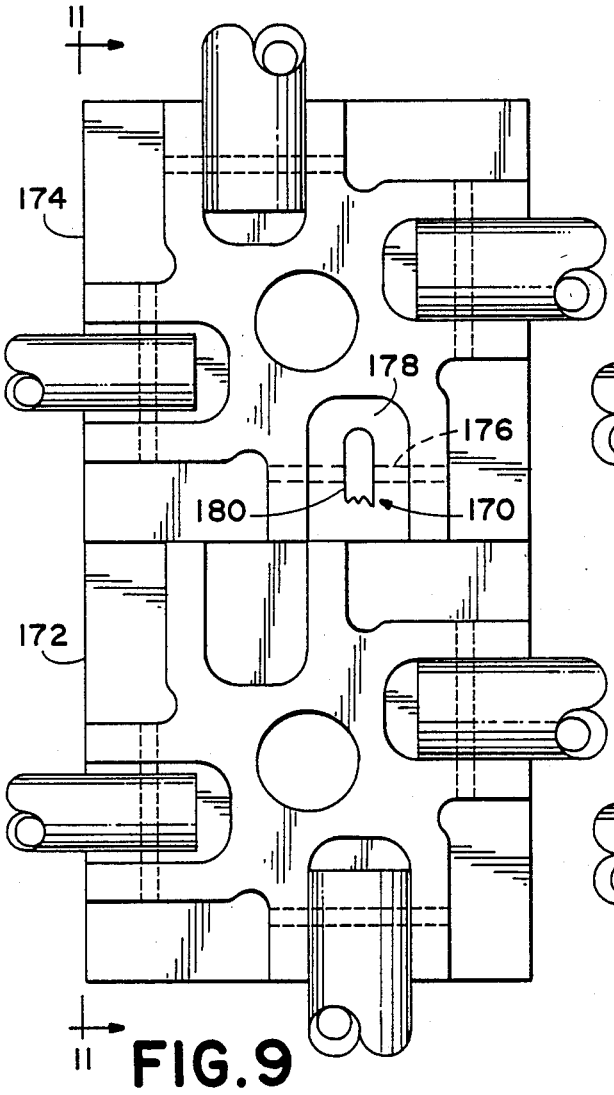
FIG. 9 is a front elevation view of a pair of abutted connector nodes.
Figure 10:
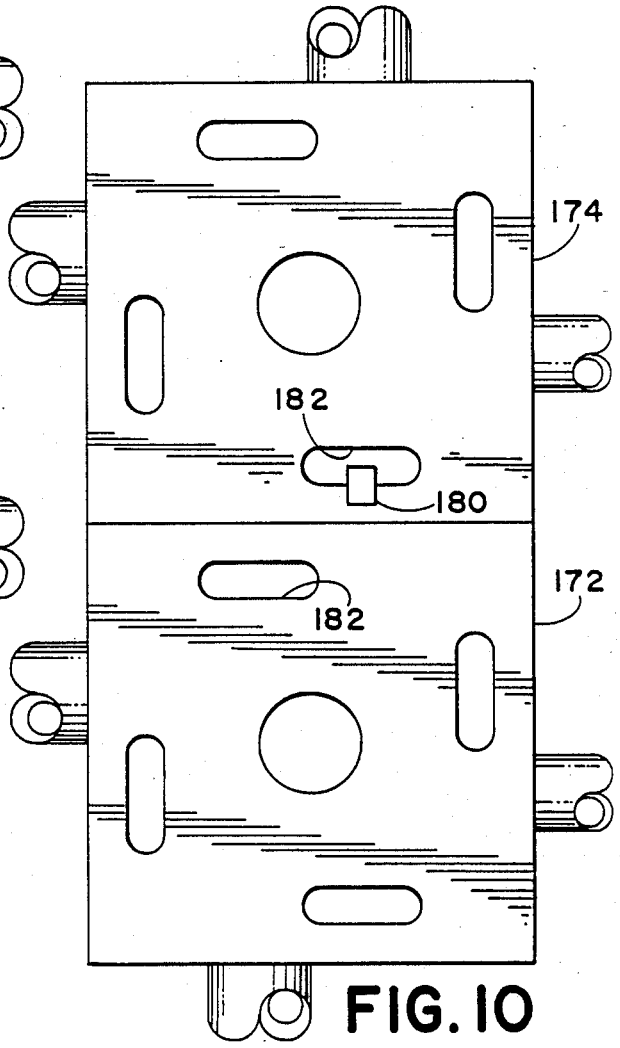
FIG. 10 is a rear elevation view of the abutted connector nodes of FIG. 9.

Referring now to FIGS. 9 and 10, joining means of the system are depicted generally at 170. Nodes 172, 174 are constructed as are the other nodes described herein and are representative of nodes which are located at the top, bottom and sides of a frame. Node 174 includes a node pin 176, located in a receptacle 178. A latch 180 is rotatably mounted on pin 176. Latch 180, which is shown only fragmentarily in the drawings, extends through a node slot 182 in the adjacent node. Node slots 182 are not shown in most of the figures to simplify the drawings. The opposite end 184 of latch 180 is sized and is operable to grasp a node 172 through slot 182 adjacent receptacle 188 of node 172. This enables the assembly of multiple units together by latching the edges of multiple frames together in series, or by positioning multiple frames atop one another.

Once multiple frames are assembled, the various display fixing means may be attached to secure display to the frame.

Figure 11:
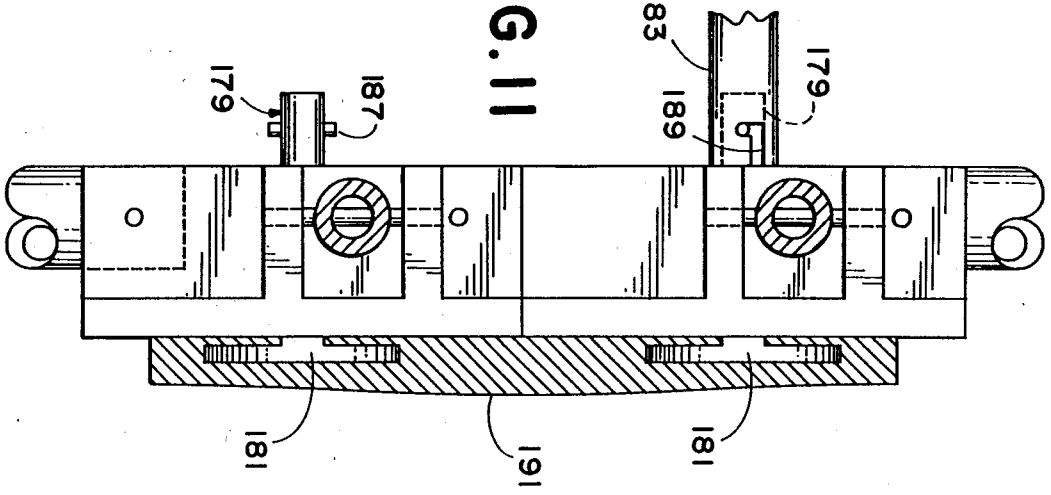
FIG. 11 is a side elevation, partially sectioned view of the abutted connector nodes, taken generally along line 11—11 of FIG. 9.

Another, actually preferred, system for joining adjacent box units is depicted in FIG. 11. That system includes a peg 179 having a round head 181 at one end thereof. Peg 179 is designed to fit, snugly into bore 60, like the previously described shaft 108.

FIG. 11 also depicts a rod 180 which is included in the preferred mode but which has not been shown in the other figures. Rod 183 preferably extends between some of the nodes 102 to anchor the entire system 100 in a fixed, expanded portion. Rod 183 is mounted between nodes 102 by engagement of an end of each of pegs 179, which end each includes an extension pin 185, with a pin 187 passing therethrough. Transverse pin 187 is engaged with an L-shaped slot 189 in rod 183, as shown in FIG. 11.

FIG. 11 further depicts the presently preferred joinder means for assembly of multiple units. The joinder means comprises a web 191 which is similar in configuration to web 132 previously described except that it has greater width so that it can extend across adjacent nodes of the two units to be joined. Web 191 includes linear sections having elastic joinders (not shown) which are like straps 135 and which permit adjacent sections to be stretched at their joinders, to fit over head 181 in peg 179. A receiver (not shown), corresponding to receiver 128 in the previously described embodiment, is also included for each pin head 181.

Figure 12:
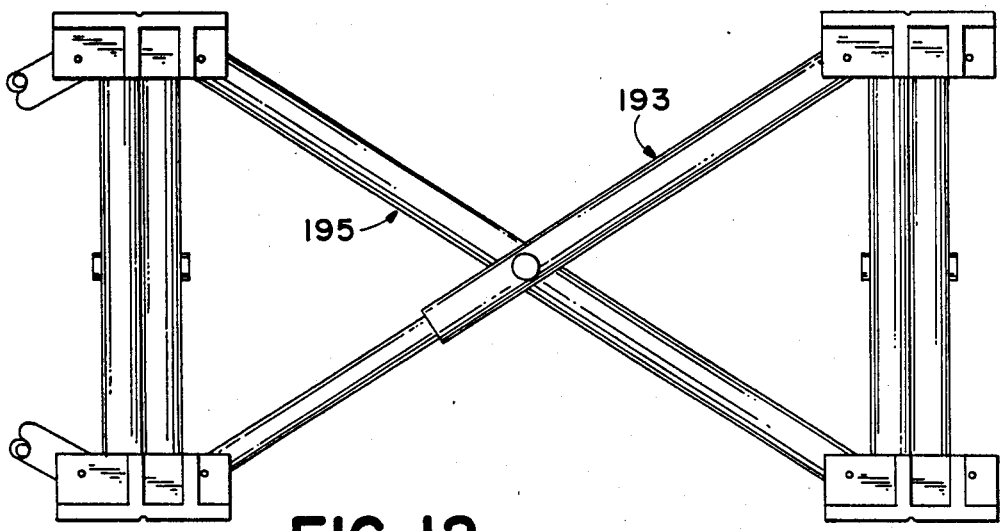
FIG. 12 is an enlarged view of a portion of a modified frame of the invention.

FIG. 12 depicts an embodiment, which is again actually preferred over that described above, which includes two telescoping arms 193 and 195 in a single side of a box unit, rather than having a telescoping arm in the top and bottom side of a box unit as depicted in FIGS. 1 and 4. In all other respects, the embodiment of FIG. 12 is identical to that described above.

Thus, a display system having a collapsible frame and various display fixing means for fixing displays to the frame has been disclosed. The invention is not restricted to the particular embodiments which have been described, since variations may be made therein without departing from the scope of the invention as defined in the claims.

It is claimed and desired to secure as Letters Patent:

1. A portable display system comprising:

a collapsible rectangular frame including a plurality of rectangular box units, each unit having a top side, bottom side, right side, left side, front face and rear face, wherein said top side, bottom side, right side and left side may be shared with adjoining box units, said top side, bottom side, right side and left side each being defined by a pair of arms, the arms in each pair being joined to one another by a scissor connection intermediate their ends, said top side arms and said bottom side arms further including a telescoping member in at least one of said arms of an arm pair, said telescoping member including a large-diameter element and a small-diameter element slidably received in said large-diameter element about said scissor connection; and connector block nodes located at each corner of said box units, each of said nodes including pivot means for securing said arms thereto and for allowing collapsing of said frame to a compact form.

2. The system of claim 1 wherein each of said nodes includes perpendicular node axes and said pivot means includes plural receptacles arranged in a generally cruciform shape offset across the adjoining axis on opposing sides of said node, each receptacle including a pair of opposed, spaced-apart walls extending parallel to a node axis, and having a base adjacent the center of said node, and a node pin spanning the space between said receptacle walls.

3. The system of claim 2 wherein said receptacles are arranged about a central region, said region having a bore extending therethrough, said bore having an axis perpendicular to said node axes.

4. The system of claim 3 wherein said node has an exterior surface, facing outward from said frame, and an interior surface, facing toward the interior of said frame, said interior surface having open areas therein over said receptacles and said exterior surface being solid over said receptacles, said bore extending through said exterior surface.

5. The system of claim 4 which further includes display fixing means.

6. The system of claim 5 wherein said display fixing means includes brackets arranged on said frame in an array extending between said nodes, and fastening means securing said brackets to said nodes, said fastening means being constructed and arranged to be receivable in said bores of said nodes and to hold said brackets to said nodes.

7. The system of claim 6, further comprising web means and wherein said bracket includes attachment means thereon for securing said web means to said frame.

8. The system of claim 7 wherein said attachment means includes magnet means to secure said web to said brackets.

9. The system of claim 6 wherein said bracket includes a rear face, a pair of opposed front faces, and a receiver at each end thereof constructed and arranged to receive said fastening means therethrough.

10. The system of claim 9 wherein said bracket further comprises curved, resilient sides extending between said rear face and said front faces.

11. The system of claim 5 wherein said display fixing means includes display holders having a shaft which is clearance fittable in said bore and a head which has a slot formed therein for receiving an edge of a display therein.

12. The system of claim 11 wherein said node includes a groove formed in said exterior surface, intersecting the axis of said bore and extending parallel to an axis of said node, and wherein said display holder includes index means for registering with said groove to align said fastening means relative to said node.

13. The system of claim 2 further comprising joining means secured to said node pins along at least one edge of said frame, said nodes including a node slot extending parallel to said node pins along at least one edge of said frame, and located across a node axis from said node pin, said joining means being constructed and arranged to interlock with said node slots on a second frame to secure the second frame to the first mentioned frame.

14. The system of claim 1 wherein each of said scissor connected arms include elongate tubular elements secured at the ends thereof to said nodes and which are joined intermediate the ends thereof by a scissor pin and wherein said telescoping member includes a large diameter element and a small diameter element slidably received in said large diameter element, said small diameter element having opposed slots formed diametrically in the wall thereof which are fittable around said scissor pin.

15. A portable display system comprising:

a collapsible rectangular frame including a plurality of rectangular box units, each unit having a top side, bottom side, right side, left side, front face and rear face, wherein said top side, bottom side, right side and left side may be shared with adjoining box units, said top side, bottom side, right side and left side each being defined by a pair of arms, including elongate tubular elements secured at the ends thereof to said nodes, the arms in each pair being joined to one another by a scissor connection including a scissor pin, said top side arms and said bottom side arms having a telescoping member in one of said arms of a pair, said telescoping member including a large diameter element and a small diameter element slidably received in said large diameter element, said small diameter element having opposed slots formed diametrically in the wall thereof which are fittable around said scissor pin; and connector block nodes located at each corner of said box units, each of said node including pivot means for securing said arms thereto and for allowing collapsing of said frame to be a compact form.

16. The system of claim 15 wherein each of said nodes include perpendicular node axes and said pivot means includes plural receptacles arranged about a central region in a generally cruciform shape, each receptacle including a pair of opposed, spaced-apart walls extending parallel to a node axis, and having a base adjacent the center of said node, and a node pin spanning the space between said receptacle walls, said central region having a bore extending therethrough, said bore having an axis perpendicular to said node axis.

17. The system of claim 16 wherein said node has an exterior surface, facing outward from said frame, and an interior surface, facing toward the interior of said frame, said interior surface having open areas therein over said receptacles and said exterior surface being solid over said receptacles, said bore extending through said exterior surface.

18. The system of claim 17 which further includes display fixing means.

19. The system of claim 18 wherein said display fixing means includes brackets arranged on sid frame in an array extending between said nodes, and fastening means securing said brackets to said nodes, said fastening means being constructed and arranged to be receivable in said bores of said nodes and to hold said brackets to said nodes.

20. The system of claim 19 further comprising web means and wherein said bracket includes attachment means thereon for securing said web means to said frame.

21. The system of claim 20 wherein said attachment means includes magnet means to secure said web to said brackets.

22. The system of claim 19 wherein said bracket includes a rear face, a pair of opposed front faces, and a receiver at each end thereof constructed and arranged to receive said fastening means therethrough.

23. The system of claim 22 wherein said bracket further comprises curved, resilient sides extending between said rear face and said front faces.

24. The system of claim 18 wherein said display fixing means includes display holders having a shaft which is clearance fittable in said bore and a head which has a slot formed therein for receiving an edge of a display therein.

25. The system of claim 24 wherein said node includes a groove formed in said exterior surface, intersecting the axis of said bore and extending parallel to an axis of said node, and wherein said display holder includes index means for registering with said groove to align said fastening means relative to said node.

26. The system of claim 15 further comprising joining means secured to said node pins along at least one edge of said frame constructed and arranged to interlock with said node pins on a second frame to secure the second frame to the first mentioned frame.

27. A portable display system comprising:

a collapsible rectangular frame including a plurality of rectangular box units, each unit having a top side, bottom side, right side, left side, front face and rear face, wherein said top side, bottom side, right side and left side may be shared with adjoining box units, said top side, bottom side, right side and left side being defined by a pair of arms, the arms in each pair being joined to one another by a scissor connection, each arm in said top side and said bottom side having a large diameter element and a small diameter element slidably received in said large diameter element to provide flexing of the frame in a forward direction toward said front face or a rearward direction toward said rear face; and connector block nodes located at each corner of said box units, each of said nodes including a planar exterior surface facing outward from said frame and an interior surface facing the interior of said frame having a central region with a bore extending therethrough, pivot means including opposed arm-receiving receptacles surrounding said central region in a generally cruciform shape, each receptacle having a pair of opposed, spacedapart walls and a base extending between said walls adjacent said central region, and an open side facing laterally outward from said node, and a node pin received in the walls of each receptacle for pivotably securing said arms to said nodes.

28. The system of claim 27 which further includes display fixing means.

29. The system of claim 28 wherein said display fixing means includes brackets arranged on said frame in a vertically disposed array between consecutive vertical nodes, and fastening means securing said brackets to said nodes, said fastening means being receivable in said bores and to hold said brackets to said nodes.

30. The system of claim 29 which further includes web means and wherein said bracket includes attachment means thereon for securing said web means to said frame.

31. The system of claim 30 wherein said attachment means includes magnet means to secure said web to said brackets.

32. The system of claim 30 wherein a plurality of said brackets are included, with elastic means extending between at least a pair of said brackets.

33. The system of claim 29 wherein said bracket includes a rear face, curved, resilient sides and a pair of opposed front faces having a longitudinally extending gap therebetween, and a central channel extending the length thereof, and a receiver at each end thereof constructed and arranged to receive said fastening means therethrough.

34. The system of claim 29 wherein said fastening means includes index means for registering with said groove to align said fastening means relative to said node.

35. The system of claim 28 wherein said display fixing means includes display holders having a shaft which is clearance fittable in said bore and a head which has a slot formed therein for receiving an edge of a display therein.

36. The system of claim 27 which further includes joining means secured to said node pin along at least one edge of said frame constructed and arranged to interlock with said node pins on a second frame to secure the second frame to the first mentioned frame.

37. The system of claim 27 wherein said scissor connected arms include elongate tubular elements secured at the ends thereof to said nodes and which are joined intermediate the ends thereof by a scissor pin and wherein said top side arms and said bottom side arms include a telescoping member in at least one said said arms, said telescoping member including a large diameter element and a small diameter element slidably received in said larger diameter element, said small diameter element having opposed slots formed diametrically in the wall thereof which are fittable around said scissor pin.

38. A portable display system comprising:

a collapsible rectangular frame including a plurality of rectangular box units, each unit having a top side, bottom side, right side, left side, front face and rear face, wherein said top side, bottom side, right side and left side may be shared with adjoining box units, said top side and said bottom side each being defined by a pair of arms, including elongate tubular elements secured at the ends thereof to said nodes, the arms in each pair being joined to one another by a scissor connection including a scissor pin, said top side arms and said bottom side arms having a telescoping member in at least one of said arms of a pair, said telescoping member including a large diameter element and a small diameter element slidably received in said large diameter element, said small diameter element having opposed slots formed diametrically in the wall thereof which are fittable around said scissor pin; and connector block nodes located at each corner of said box units, each of said node including pivot means for securing said arms thereto and for allowing collapsing of said frame to a compact form.

39. The system of claim 38 wherein each of said nodes include perpendicular node axes and said pivot means includes plural receptacles arranged about a central region in a generally cruciform shape, each receptacle including a pair of opposed, spaced-apart walls extending parallel to a node axis, and having a base adjacent the center of said node, and a node pin spanning the space between said receptacle walls, said central region having a bore extending therethrough, said bore having an axis perpendicular to said node axis, each node further having an exterior surface, facing outward from said frame, and an interior surface, facing toward the interior of said frame, said interior surface having open areas therein over said receptacles and said exterior surface being solid over said receptacles, said bore extending through said exterior surface.

40. The system of claim 38 which further includes display fixing means.

41. The system of claim 40 wherein said display fixing means includes brackets arranged on said frame in an array extending between said nodes, and fastening means securing said brackets to said nodes, said fastening means being constructed and arranged to be receivable in said bores of said nodes and to hold said brackets to said nodes.

42. The system of claim 41 further comprising web means and wherein said bracket includes attachment means thereon for securing said web means to said frame.

43. The system of claim 42 wherein said attachment means includes magnet means to secure said web to said brackets.

44. The system of claim 41 wherein said bracket includes a rear face, a pair of opposed front faces, and a receiver at each end thereof constructed and arranged to receive said fastening means therethrough.

45. The system of claim 44 wherein said bracket further comprises curved, resilient sides extending between said rear face and said front faces.

46. The system of claim 41 wherein said display fixing means includes display holders having a shaft which is clearance fittable in said bore and a head which has a slot formed therein for receiving an edge of a display therein.

47. The system of claim 46 wherein said node includes a groove formed in said exterior surface, intersecting the axis of said bore and extending parallel to an axis of said node, and wherein said display holder includes index means for registering with said groove to align said fastening means relative to said node.

48. The system of claim 38 further comprising joining means secured to said node pins along at least one edge of said frame constructed and arranged to interlock with said node pins on a second frame to secure the second frame to the first mentioned frame.

* * * * *